US007540525B2

(12) United States Patent
Ametsbichler et al.

(10) Patent No.: US 7,540,525 B2
(45) Date of Patent: Jun. 2, 2009

(54) FASTENING DEVICE FOR A SKIN, SNOW GLIDE BOARD/SKIN COMBINATION AND SKIN FOR USE ON A SNOW GLIDE BOARD

(75) Inventors: Andreas Ametsbichler, Straubing (DE); Klaus Blüml, Niedermotzing (DE)

(73) Assignee: Marker Volkl International GmbH, Baar (CH)

( * ) Notice: Subject to any disclaimer, the term of this patent is extended or adjusted under 35 U.S.C. 154(b) by 0 days.

(21) Appl. No.: 11/600,866

(22) Filed: Nov. 17, 2006

(65) Prior Publication Data

US 2007/0114779 A1 May 24, 2007

(30) Foreign Application Priority Data

| | | |
|---|---|---|
| Nov. 18, 2005 | (DE) | 20 2005 018 187 U |
| Mar. 8, 2006 | (DE) | 20 2006 003 785 U |
| Jul. 8, 2006 | (DE) | 10 2006 031 670 |
| Jul. 25, 2006 | (DE) | 10 2006 034 227 |

(51) Int. Cl.
*A63C 7/04* (2006.01)

(52) U.S. Cl. ..... 280/604; 280/809

(58) Field of Classification Search ..... 280/604, 280/809

See application file for complete search history.

(56) References Cited

U.S. PATENT DOCUMENTS

| | | | | |
|---|---|---|---|---|
| 2,189,760 | A * | 2/1940 | Matthee et al. | 280/604 |
| 2,326,802 | A * | 8/1943 | Robinson et al. | 280/604 |
| 3,353,835 | A * | 11/1967 | Sommer | 280/612 |
| 3,620,543 | A * | 11/1971 | Peis et al. | 280/601 |
| 3,977,688 | A * | 8/1976 | Imagawa | 280/633 |
| 4,564,210 | A * | 1/1986 | Case | 280/604 |
| 4,770,441 | A * | 9/1988 | Demonsant et al. | 280/818 |
| 6,007,086 | A * | 12/1999 | Hopkins | 280/612 |
| 6,105,990 | A * | 8/2000 | Sutherland | 280/604 |
| 6,471,234 | B2 * | 10/2002 | Ayliffe | 208/604 |
| 7,118,117 | B2 * | 10/2006 | Terry | 280/87.042 |
| 7,287,775 | B2 * | 10/2007 | Walker et al. | 280/604 |

FOREIGN PATENT DOCUMENTS

| | | |
|---|---|---|
| DE | 2 364 558 | 7/1974 |
| DE | 33 18259 A1 | 11/1984 |
| WO | WO 2004/064949 | 8/2004 |

* cited by examiner

*Primary Examiner*—Christopher P Ellis
*Assistant Examiner*—John D Walters
(74) *Attorney, Agent, or Firm*—Hoffman, Wason & Gitler

(57) ABSTRACT

The invention relates to a new type of fastening device for fastening a skin to a glide board body, in particular a ski body, with at least one glide board body fastening element that can be anchored in the glide board body, forming at least one mount that is open on the bottom of the glide board, and with one skin-side fastening element, which can be inserted into the at least one mount in order to fasten the skin.

30 Claims, 2 Drawing Sheets

FASTENING DEVICE FOR A SKIN, SNOW GLIDE BOARD/SKIN COMBINATION AND SKIN FOR USE ON A SNOW GLIDE BOARD

BACKGROUND OF THE INVENTION

The invention relates to a fastening device for fastening a skin to a glide board body, in particular to a ski body, the fastening device having at least one glide board body fastening element that can be anchored in the glide board body and that forms at least one mount that is open on the bottom of the glide board, and at least one skin-side fastening element that can be inserted into the at least one mount in order to fasten the skin.

The invention relates also to a snow glide board/skin combination with at least one fastening device (4) for releasable fastening of the skin (3) on the bottom of the glide board body.

The invention relates further to a skin for use on a glide board, in particular a ski, with a skin-side fastening element that can be fastened on a mount of a glide board body or ski body.

Various devices or methods are known in the art for fastening skins to skis, in particular to cross-country skis. A very common method for fastening skins consists in providing the ski body, at least at the front end, or in the blade area, with a through opening, in which a hook-shaped skin-side fastening element can be inserted and hooked for fastening the skin. The through opening extending from the top of the ski to the bottom of the ski to form the ski-side fastening element is at least visually disturbing.

It is an object of the invention to present a fastening device, which enables convenient handling while maintaining a visually attractive appearance for the snow glide board or ski body.

SUMMARY OF THE INVENTION

This object is achieved by a fastening device for fastening a skin to a glide board body, in particular to a ski body, with at least one glide board body fastening element that can be anchored in the glide board body and that forms at least one mount that is open on the bottom of the glide board, and with one skin-side fastening element that can be inserted into the at least one mount in order to fasten the skin, said fastening device having at least one permanent magnet for securing the at least one skin-side fastening element in the mount.

The glide board/skin combination includes at least one glide board and at least one fastening device for releasable fastening of the skin on the bottom of the glide board body, wherein the fastening device has at least one glide board body fastening element that can be anchored in the glide board body and that forms at least one mount that is open on the bottom of the glide board, and at least one skin-side fastening element that can be inserted into the at least one mount in order to fasten the skin. The fastening device has at least one permanent magnet for securing the at least one skin-side fastening element in the mount.

The skin for use on a glide board, in particular on a ski, has a skin-side fastening element that can be fastened on a mount of a glide board body or ski body, wherein the skin-side fastening element includes at least one permanent magnet, which for the purpose of fastening to the glide board body works together with a glide board body fastening element there consisting at least partially of a ferromagnetic material and/or formed by a permanent magnet.

In the fastening device according to the invention, the skin is fastened simply by inserting the skin-side fastening element into the mount or holder, for example recess of the board-side fastening element. The magnetic forces then hold the skin-side fastening element securely in the mount or holder. Forces that act between the skin and the glide board body are transferred partially through magnetic forces, but to a great or greater extent purely mechanically between the skin-side fastening element and the board-side fastening element.

BRIEF DESCRIPTION OF THE DRAWINGS

The invention is described below based on exemplary embodiments with reference to the drawings, in which.

Figure 1:
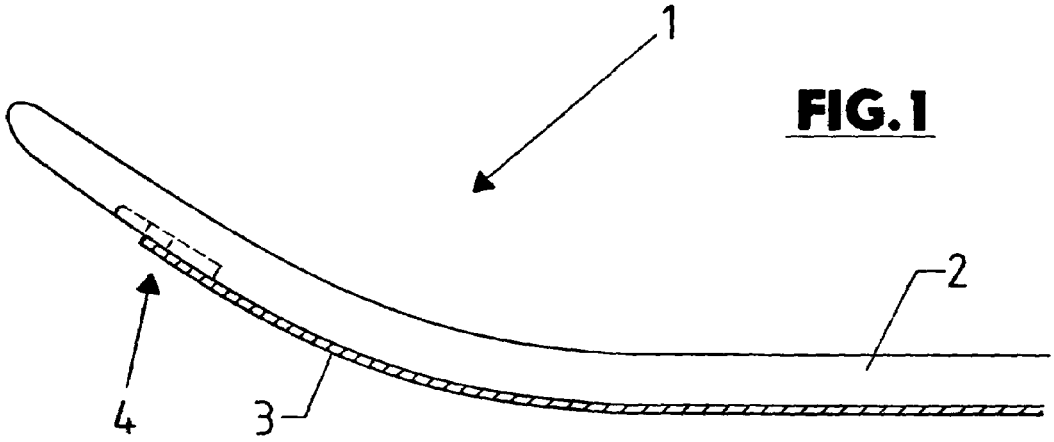
FIG. 1 shows a simplified schematic representation of a cross-country ski in the area of its front end (blade area) together with a skin fastened to a fastening device there.

In the drawings, 1 generally designates a cross-country ski, the ski body 2 of which—with the exception of the special characteristics described in the following—features the usual structure, and 3 designates a skin, which is provided on the bottom side of the ski body 2 and can be releasably fastened at the front end (blade area) and at the rear end of the ski body 2.

This releasable connection is achieved by means of fastening devices 4, of which for the sake of clarity only fastening device 4 at the blade area of the ski body 2 is depicted in the drawings. The fastening device 4 provided at the rear end of the ski body 2, has, for example, an identical design.

The fastening device 4 consists of one ski body fastening element 5 and of one skin-side fastening element 6. The fastening element 5 in the depicted embodiment is designed as a flat insert, which is inserted at the bottom of the ski body 2 in the upward curved section of the blade area, in particular so that it fits into the running surface coating 7 forming the bottom side of the ski body 2. The fastening element 5 is not visible on the top side of the ski body 2.

In the depicted embodiment, the fastening element 5 has a two-part design, i.e. it consists of a flat molded or injected molded part 8 made of plastic, which when the fastening element 5 is in mounted state on the bottom side of the ski body 2, is visible and flush with the running surface, and of a further inner part 9 made of a ferromagnetic material and which is flat and plate-shaped in the depicted embodiment. The outer part 8 is provided with a recess 10 that forms a mount and is open at an insertion opening on the bottom side of the ski body and closed on the side opposing this opening through the plate-shaped part 9, which is made for example from a sheet metal blank. In order not to interfere with the usual structure of the ski body 2, the flat or plate-shaped part 8 has a thickness, for example, that is equal to or only slightly greater than the thickness of the running surface coating 7. The fastening element 5 and its part 8 can be designed for example as a visible company emblem on the bottom of the ski.

The skin-side fastening element 6 is designed as a cylindrical permanent magnet, which is fastened in a suitable manner to the inner side of the skin 3 facing the ski body 2 when in use, and which can be used to fasten the skin 3 into the recess 10, so that the fastening element 6 or the permanent magnet is held magnetically to the bottom of the recess 10 formed by part 9. The fastening element 6 is held by the magnetic force in the recess 10 of the fastening element 5, so that tensile forces (arrow K) exerted via the skin 3 do not release the connection between the fastening elements 5 and 6. Since the diameter of the recess 10 is optimized to match the diameter of the fastening element 6, a majority of the tensile forces is already transferred purely mechanically from the skin 3 to the skin body 2 due to the engaging of the fastening elements 5 and 6.

Figure 2:
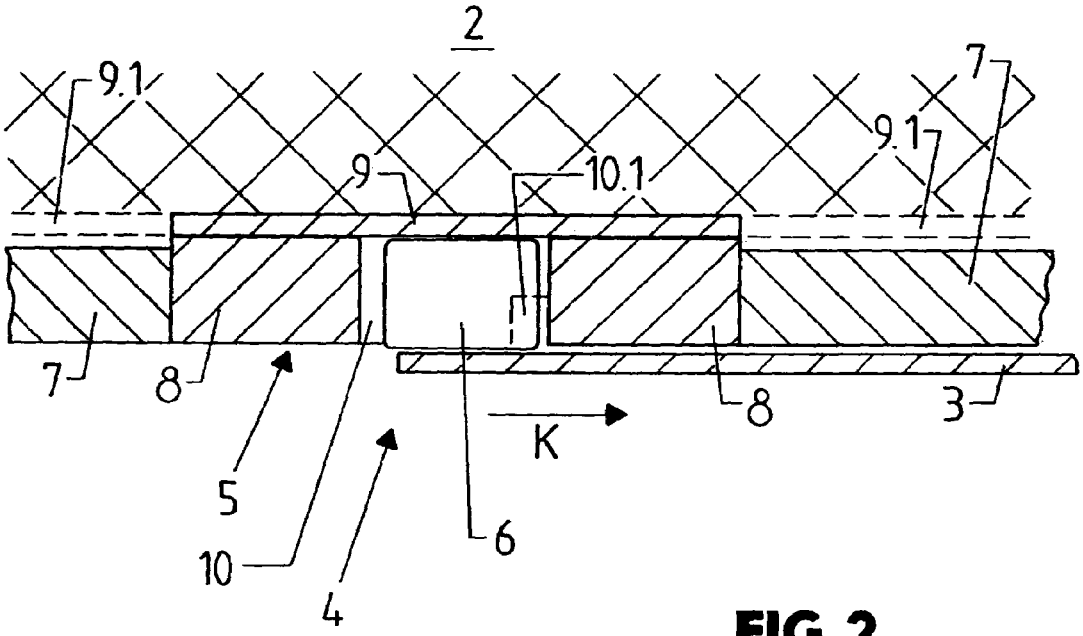
FIG. 2 shows an enlarged component drawing of the fastening device for the skin.

As indicated in FIG. 2 by 10.1, the recess 10 can also be provided with an undercut, which then is engaged from behind by the fastening element 6 for additionally securing the connection between the skin 3 and the ski body 2 when under load.

Figure 3:
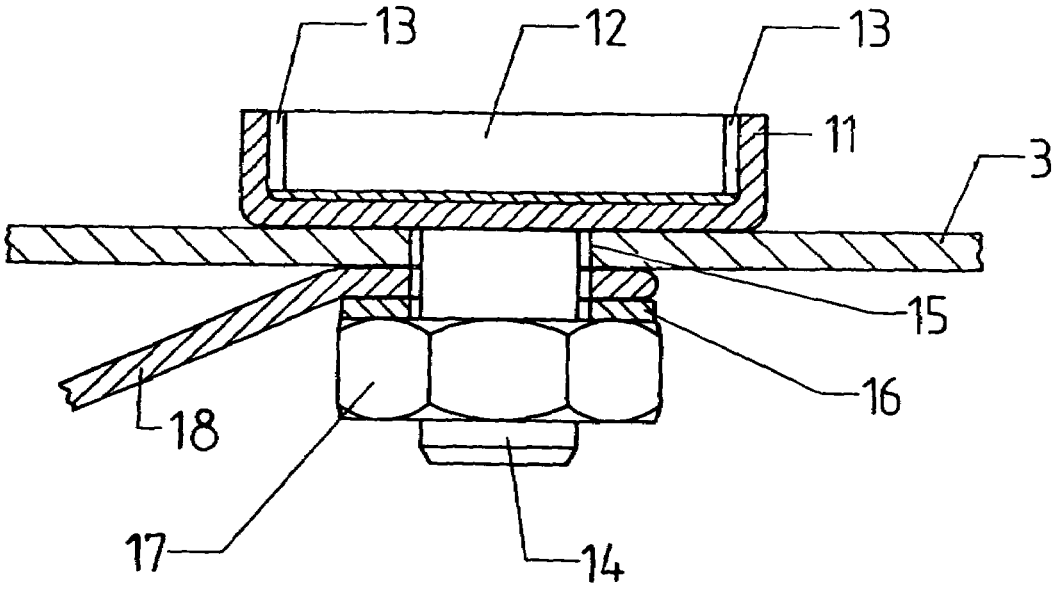
FIG. 3 shows a cross section through a skin and the skin-side fastening element in a further embodiment of the invention.

FIG. 3 shows a cross section through the skin 3 and a fastening element 6*a* corresponding in function to the fastening element 6. Fastening element 6*a* consists essentially of a bowl-shaped body 11 made of a ferromagnetic material, and of a circular permanent magnet 12 fastened in said body for example by gluing. The thickness of the permanent magnet 12 is such that it lies with one face in a common plane with the edge of the bowl-shaped body 11. A magnetic gap 13 is formed between the edge of the bowl-shaped body 11 and the permanent magnet 12. On the side facing away from the permanent magnet 12 the body 11 is manufactured with a stud 14, provided with external threads, which is inserted through a hole 15 in the skin 3 for mounting the fastening element 6*a* on the skin 3. The fastening element 6*a* is held to the skin 3 by means of a washer 16 and a nut 17.

In order to fasten the skin 3 to the ski 1, the fastening element 6*a* again is inserted into the opening 10 of the fastening element 5, so that the fastening element 6*a* then bears in the area of the magnetic gap 3 against the part 9 made of the ferromagnetic material and is held onto the ski there particularly securely, namely in particular also by the fact that the magnetic gap 13 is bridged by the part 9. The fastening element 6*a* and therefore the skin 3 can be released from the ski through pulling by means of an extending flap 18.

The invention was described above based on exemplary embodiments. It goes without saying that numerous modifications and variations are possible, without abandoning the underlying inventive idea upon which the invention is based. For example, it is possible to fabricate the plate-shaped part 9 of the ski's fastening element 5 from a section of a belt-shaped support element 9.1 (lower belt) made of a ferromagnetic material, for example steel, which (belt)—corresponding to the usual structure of a ski body—extends continuously from the front to the rear end of the ski body 2.

Furthermore, it was assumed that the fastening device 4 or its board-side fastening elements 5 feature only one recess 10 or mount for a skin-side fastening element 6. Of course, the fastening device 4 can also feature a plurality of skin-side fastening elements, each of which is formed by a permanent magnet or comprising a permanent magnet and each of which is then allocated to one recess 10 on the ski body.

Many various shapes are conceivable for the skin-side fastening element 6 or 6*a*: for example, cylindrical, knob-shaped, mushroom-shaped, etc. The fastening element 6 is then designed for example altogether as a permanent magnet or comprises at least one permanent magnet.

REFERENCE LIST

1 cross-country ski
2 ski body
3 skin
4 fastening device
5, 6, 6*a* fastening element
7 running surface coating
8, 9 part of the ski's fastening element
9.1 belt
10 recess
10.1 undercut
11 bowl-shaped pre-formed body
12 permanent magnet
13 magnetic gap
14 stud
15 hole
16 washer
17 nut
19 flap
K force

What is claimed is:

1. A fastening device for fastening a skin to a glide board body with at least one glide board body fastening element that is anchored in the glide board body and that forms at least one mount that is open on the bottom of the glide board, and with at least one skin-side fastening element that can be inserted into the at least one mount for fastening the skin, said fastening device comprises at least one permanent magnet for securing the at least one skin-side fastening element in the mount, wherein the glide board body fastening element is provided with one visible side that is flush with the bottom of the slide board body.

2. The fastening device as claimed in claim 1, wherein the at least one mount is formed by a recess in the glide board body fastening element.

3. The fastening device as claimed in claim 1, wherein the at least one skin-side fastening element or at least one glide board body fastening element comprise the at least one permanent magnet or are at least partially formed by the latter.

4. The fastening device as claimed in claim 1, wherein the at least one glide board body fastening element is made of a ferromagnetic material at least in a partial area of the at least one recess.

5. The fastening device as claimed in claim 4, wherein the at least one recess at one bottom area opposing an insertion opening is made of the ferromagnetic material.

6. The fastening device as claimed in claim 5, wherein the bottom area is formed from sheet metal made of ferromagnetic material.

7. The fastening device as claimed in claim 6, wherein the sheet metal is formed by a partial section of a belt-shaped support element provided in the glide board body.

8. The fastening device as claimed in claim 1, wherein the at least one mount forms at least one undercut, which is engaged from behind by the at least one skin-side fastening element.

9. The fastening device as claimed in claim 1, wherein the glide board body fastening element is formed by a molded part comprising the at least one mount, the molded part is made of plastic.

10. The fastening device as claimed in claim 9, wherein the molded part has a thickness that is equal to or slightly greater than the thickness of a running surface coating forming the bottom of a glide board body.

11. The fastening device as claimed in claim 9, wherein the molded part has a thickness that is equal to or slightly less than the thickness of a running surface coating forming the bottom of the glide board body.

12. The fastening device as claimed in claim 1, wherein the at least one skin-side fastening element consists of a bowl-shaped pre-formed body made of a ferromagnetic material and fastened to the skin, and of at least one permanent magnet fastened in a molded part.

13. The fastening device as claimed in claim 12, wherein at least one magnetic gap is formed between the at least one permanent magnet and one edge of the pre-formed body.

14. A glide board body/skin combination with at least one fastening device for releasable fastening of the skin on a bottom of the glide board body, wherein the fastening device comprises at least one glide board body fastening element that is anchored in the glide board body and that forms at least one mount that is open on the bottom of the glide board, and at least one skin-side fastening element that is inserted into the at least one mount for fastening the skin, said fastening device further comprises at least one permanent magnet for securing the at least one skin-side fastening element in the mount, wherein the glide board body fastening element is provided with one visible side that is flush with the bottom of the glide board body.

15. The glide board body/skin combination as claimed in claim 14, wherein the at least one mount is formed by a recess in the glide board body fastening element.

16. The glide board body/skin combination as claimed in claim 14, wherein the at least one skin-side fastening element and/or the at least one glide board body fastening element comprise the at least one permanent magnet or are at least partially formed by the latter.

17. The glide board body/skin combination as claimed in claim 14, wherein the at least one glide board body fastening element is made of a ferromagnetic material at least in a partial area of the at least one recess.

18. The glide board body/skin combination as claimed in claim 17, wherein the at least one recess at one bottom area opposing an insertion opening is made of the ferromagnetic material.

19. The glide board body/skin combination as claimed in claim 18, wherein the one bottom area is formed from sheet metal made of ferromagnetic material.

20. The glide board body/skin combination as claimed in claim 19, wherein the sheet metal is formed by a partial section of a belt-shaped support element provided in the glide board body.

21. The glide board body/skin combination as claimed in claim 14, wherein the at least one mount forms at least one undercut, which is engaged from behind by the at least one skin-side fastening element.

22. The glide board body/skin combination as claimed in claim 14, wherein the glide board body fastening element is formed by a molded part comprising the at least one mount, the molded part is made of plastic.

23. The glide board body/skin combination as claimed in claim 22, wherein the molded part has a thickness that is equal to or slightly greater than the thickness of a running surface coating forming the bottom of the glide board body.

24. The glide board body/skin combination as claimed in claim 22, wherein the molded part has a thickness that is equal to or slightly less than the thickness of a running surface coating forming the bottom of the glide board body.

25. The glide board body/skin combination as claimed in claim 14, wherein the at least one skin-side fastening element consists of a bowl-shaped pre-formed body made of a ferromagnetic material and fastened to the skin, and of at least one permanent magnet fastened in the molded part.

26. The glide board body/skin combination as claimed in claim 25, wherein at least one magnetic gap is formed between the at least one permanent magnet and one edge of the pre-formed body.

27. A skin for use on a glide board with a skin-side fastening element that is fastened on a mount of a glide board body, wherein the skin-side fastening element comprises at least one permanent magnet, which for the purpose of fastening to the glide board body works together with a glide board body fastening element there consisting at least partially of a ferromagnetic material and or formed by a permanent magnet, wherein the skin-side fastening element consists of a bowl-shaped pre-formed body made of a ferromagnetic material, in which at least one permanent magnet is held.

28. The skin as claimed in claim 27, wherein the skin-side fastening element is fastened to the skin by gluing or through the use of at least one mechanical fastening element.

29. A fastening device for fastening a skin to a glide board body, with at least one glide board body fastening element that is anchored in the glide board body and that forms at least one mount that is open on the bottom of the glide board, and this at least one skin-side fastening element that can be inserted into the at least one mount for fastening the skin, said fastening device comprising at least one permanent magnet for securing the at least one skin-side fastening element in the mount, the at least one skin-side fastening element consisting of a bowl-shaped pre-formed body made of ferromagnetic material and fastened to the skin, and of at least one permanent magnet held in the bowl-shaped pre-formed body.

30. A glide board body/skin combination with at least one fastening device for releasable fastening of the skin on a bottom of the glide board body, wherein the fastening device comprises at least one glide board body fastening element that is anchored in the glide board body and that forms at least one mount that is open on the bottom of the glide board, and at least one skin-side fastening element that is inserted into the at least one mount for fastening skin, said fastening device further comprises at least one permanent magnet for securing the at least one skin-side fastening element in the mount, the at least one skin-side fastening element consisting of a bowl-shaped pre-formed body made of ferromagnetic material and fastened to the skin, and of at least one permanent magnet held in the bowl-shaped pre-formed body.

* * * * *